US011401958B2

(12) United States Patent
Olsson

(10) Patent No.: US 11,401,958 B2
(45) Date of Patent: Aug. 2, 2022

(54) ARRANGEMENT AND METHOD FOR OPERATING A HYDRAULIC CYLINDER

(71) Applicant: HUSQVARNA AB, Huskvarna (SE)

(72) Inventor: Tommy Olsson, Mölndal (SE)

(73) Assignee: HUSQVARNA AB, Huskvarna (SE)

( * ) Notice: Subject to any disclaimer, the term of this patent is extended or adjusted under 35 U.S.C. 154(b) by 264 days.

(21) Appl. No.: 16/307,051

(22) PCT Filed: May 17, 2017

(86) PCT No.: PCT/SE2017/050519
§ 371 (c)(1),
(2) Date: Dec. 4, 2018

(87) PCT Pub. No.: WO2017/213571
PCT Pub. Date: Dec. 14, 2017

(65) Prior Publication Data

US 2019/0113057 A1 Apr. 18, 2019

(30) Foreign Application Priority Data

Jun. 9, 2016 (SE) ..... 1650805-3

(51) Int. Cl.
*F15B 15/28* (2006.01)
*F15B 11/048* (2006.01)
(Continued)

(52) U.S. Cl.
CPC ..... *F15B 15/2815* (2013.01); *E02F 3/963* (2013.01); *E02F 3/965* (2013.01);
(Continued)

(58) Field of Classification Search
CPC ..... F15B 15/2815; F15B 11/048; F15B 11/0406; F15B 2211/7653; F15B 2211/6336; E02F 3/966
See application file for complete search history.

(56) References Cited

U.S. PATENT DOCUMENTS 4,419,040 A 12/1983 Pedersen et al.
4,718,325 A 1/1988 Shore
(Continued)

FOREIGN PATENT DOCUMENTS

CN 1126804 A 7/1996
CN 101078411 A 11/2007
(Continued)

OTHER PUBLICATIONS

International Search Report and Written Opinion for International Application No. PCT/SE2017/050519 dated Jul. 28, 2017.
(Continued)

*Primary Examiner* — Abiy Teka
(74) *Attorney, Agent, or Firm* — Burr & Forman LLP

(57) ABSTRACT

A carrier comprising a hydraulic cylinder having a piston, a controller and a piston position sensor, wherein the carrier is arranged to carry an accessory through the use of the hydraulic cylinder and wherein the controller is configured to: receive piston position information; determine a direction of movement of the piston; and if the piston position equals a stop distance from an end wall of the hydraulic cylinder in the direction of movement, abort the movement.

15 Claims, 3 Drawing Sheets

(51) Int. Cl.

| | |
|---|---|
| ***E02F 9/26*** | (2006.01) |
| ***E02F 3/96*** | (2006.01) |
| ***E02F 9/22*** | (2006.01) |
| *E02F 3/34* | (2006.01) |
| *E02F 9/20* | (2006.01) |

(52) U.S. Cl.

CPC ..... *E02F 3/966* (2013.01); *E02F 9/2203* (2013.01); *E02F 9/2271* (2013.01); *E02F 9/265* (2013.01); *F15B 11/048* (2013.01); *E02F 3/3411* (2013.01); *E02F 9/205* (2013.01); *F15B 15/28* (2013.01); *F15B 2211/6336* (2013.01); *F15B 2211/7053* (2013.01); *F15B 2211/853* (2013.01)

(56) References Cited

U.S. PATENT DOCUMENTS

| | | | | |
|---|---|---|---|---|
| 4,896,582 | A | 1/1990 | Tordenmalm et al. | |
| 4,901,625 | A * | 2/1990 | Bussan | G05B 19/231 91/361 |
| 5,431,086 | A | 7/1995 | Morita et al. | |
| 5,511,458 | A | 4/1996 | Kamata et al. | |
| 5,533,435 | A | 7/1996 | Kita | |
| 7,849,685 | B2 | 12/2010 | Yamazaki et al. | |
| 8,336,444 | B2 | 12/2012 | Imamura et al. | |
| 8,453,441 | B2 | 6/2013 | Williamson et al. | |
| 9,546,672 | B2 * | 1/2017 | Perkins | F15B 15/2815 |
| 2004/0200349 | A1 | 10/2004 | Moler et al. | |
| 2013/0255245 | A1 | 10/2013 | Yi et al. | |
| 2015/0040754 | A1 | 2/2015 | Funato | |
| 2015/0047427 | A1 | 2/2015 | Ikegami et al. | |
| 2015/0345520 | A1 | 12/2015 | Schwarz et al. | |

FOREIGN PATENT DOCUMENTS

| | | | |
|---|---|---|---|
| CN | 101920249 | A | 12/2010 |
| CN | 102227565 | A | 10/2011 |
| CN | 103629172 | A | 3/2014 |
| CN | 103727089 | A | 4/2014 |
| EP | 0292373 | B1 | 5/1990 |
| GB | 1 467 336 | A | 3/1977 |
| JP | 2008-266976 | A | 11/2008 |
| SE | 536152 | C2 | 6/2013 |
| WO | 2006/122339 | A1 | 11/2006 |
| WO | 2010/059107 | A1 | 5/2010 |
| WO | 2016/014141 | A2 | 1/2016 |

OTHER PUBLICATIONS

International Preliminary Report on Patentability for International Application No. PCT/SE2017/050519 dated Dec. 11, 2018.

* cited by examiner

ARRANGEMENT AND METHOD FOR OPERATING A HYDRAULIC CYLINDER

TECHNICAL FIELD

This application relates to the operation of hydraulic cylinders, and in particular to improve operation of hydraulic cylinders used to operate booms carrying accessories.

BACKGROUND

Contemporary hydraulic cylinders are subjected to shocks both when moving and during operation. Especially the end walls of a cylinder are subjected to shocks as the piston of the cylinder is moved to an end position. However, it is difficult for an operator to always know or be able to see when he is approaching an end position of a cylinder and running the piston all the way may damage or increase the wear and tear of the cylinder, and possibly also connected parts, such as pivot pins and couplings.

To overcome this, prior art solutions provide for a soft stop functionality wherein the movement of the piston is automatically slowed down as the piston reaches an end position and thereby reduces the forces subjected to the end wall(s) and the piston as they make contact.

However, soft stop functionality only provides for a reduction of the forces when the piston reaches the end wall and also does not protect the cylinder from shocks or vibrations experienced during operation.

There is thus a need for an alternative or additional solution to soft stops for overcoming the drawbacks of the prior art.

SUMMARY

One object of the present teachings herein is to solve, mitigate or at least reduce the drawbacks of the background art, which is achieved by the appended claims. A first aspect of the teachings herein provides for a carrier comprising a hydraulic cylinder having a piston, a controller and a piston position sensor, wherein the carrier is arranged to carry an accessory through the use of the hydraulic cylinder and wherein the controller is configured to: receive piston position information; determine a direction of movement of the piston; and if the piston position equals a stop distance from an end wall of the hydraulic cylinder in the direction of movement, abort the movement so as to stop the piston at the stop distance.

A second aspect provides a method for use in a carrier comprising a hydraulic cylinder having a piston, a controller and a piston position sensor, wherein the carrier is arranged to carry an accessory through the use of the hydraulic cylinder, wherein the method comprises: receiving piston position information; determining a direction of movement of the piston; and if the piston position equals a stop distance from an end wall of the hydraulic cylinder in the direction of movement, aborting the movement so as to stop the piston at the stop distance.

One benefit is that the wear and tear of cylinders is reduced, while increasing the usability of the carrier.

Other features and advantages of the disclosed embodiments will appear from the following detailed disclosure, from the attached dependent claims as well as from the drawings.

BRIEF DESCRIPTION OF DRAWING

The invention will be described below with reference to the accompanying figures wherein.

DETAILED DESCRIPTION

Figure 1:
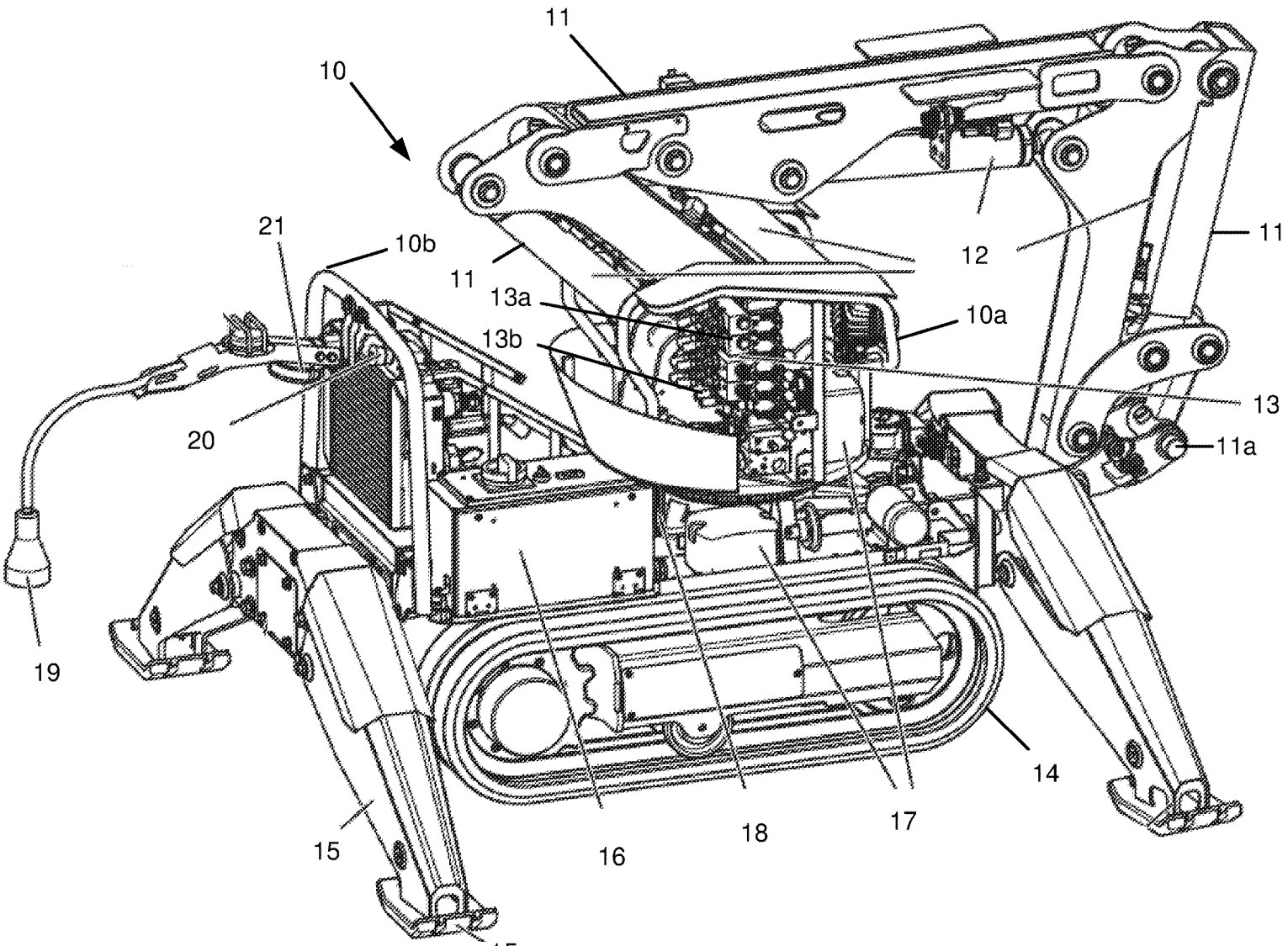
FIG. 1 shows a remote demolition robot according to an embodiment of the teachings herein.

FIG. 1 shows an example of carrier for an accessory such as a work tool or a load, which carrier in this example is a remote demolition robot 10, hereafter simply referred to as the robot 10. Although the description herein is focused on demolition robots, the teachings may also be applied to any engineering vehicle, such as excavators, backhoe loaders, and loaders, to mention a few examples, which are all examples of carriers that are arranged to carry an accessory, such as a tool or load, on an arm or boom system which is hydraulically controlled.

The robot 10, exemplifying the carrier, comprises one or more robot members, such as arms 11, the arms 11 possibly constituting one (or more) robot arm member(s). One member may be an accessory tool holder 11*a* for holding an accessory 11*b* (not shown in FIG. 1, see FIG. 3). The accessory 11*b* may be a tool such as a hydraulic breaker or hammer, a cutter, a concrete rotary cutter, a saw, or a digging bucket to mention a few examples. The accessory may also be a payload to be carried by the robot 10.

At least one of the arms 11 is movably operable through at least one hydraulic cylinder 12. The hydraulic cylinders are controlled through a hydraulic valve block 13 housed in the robot 10.

The hydraulic valve block 13 comprises one or more valves 13*a* for controlling the flow of a hydraulic fluid (oil) provided to for example a corresponding cylinder 12.

The robot 10 comprises caterpillar tracks 14 that enable the robot 10 to move. The robot 10 may alternatively or additionally have wheels for enabling it to move, both wheels and caterpillar tracks being examples of drive means. The robot may further comprise outriggers 15 that may be extended individually (or collectively) to stabilize the robot 10.

The robot 10 is driven by a drive system 16 operably connected to the caterpillar tracks 14 and the hydraulic valve block 13. The drive system 16 may comprise an electrical motor in case of an electrically powered robot 10 powered by a battery and/or an electrical cable 19 connected to an electrical grid (not shown), or a cabinet for a fuel tank and an engine in case of a combustion powered robot 10.

The body of the robot 10 may comprise a tower 10*a* on which the arms 11 are arranged, and a base 10*b* on which the caterpillar tracks 14 are arranged. The tower 10*a* is arranged to be rotatable with regards to the base 10*b* which enables an operator to turn the arms 11 in a direction other than the direction of the caterpillar tracks 14.

The operation of the robot 10 is controlled by one or more controllers 17 comprising at least one processor or other programmable logic and possibly a memory module for storing instructions that when executed by the at least one processor or other programmable logic controls a function of the demolition robot 10. The one or more controllers 17 will hereafter be referred to as one and the same controller 17 making no differentiation of which processor is executing which operation. It should be noted that the execution of a task may be divided between the controllers wherein the controllers will exchange data and/or commands to execute the task.

The robot 10 comprises a control interface 22 which may be a remote control (see FIG. 2), but may also be an arrangement of levers, buttons and possibly steering wheels as would be understood by a person skilled in the art.

The robot 10 may further comprise a radio module 18. The radio module 18 may be used for communicating with the remote control (see FIG. 2, reference 22) for receiving commands to be executed by the controller 17. The radio module may be configured to operate according to a low energy radio frequency communication standard such as ZigBee®, Bluetooth® or WiFi®. Alternatively or additionally, the radio module 18 may be configured to operate according to a cellular communication standard, such as GSM (Global Systeme Mobile) or LTE (Long Term Evolution).

For wired control of the robot 10, the remote control 22 may alternatively be connected through or along with the power cable 19. The robot may also comprise a Human-Machine Interface (HMI), which may comprise control buttons, such as a stop button 20, and light indicators, such as a warning light 21.

Figure 2:
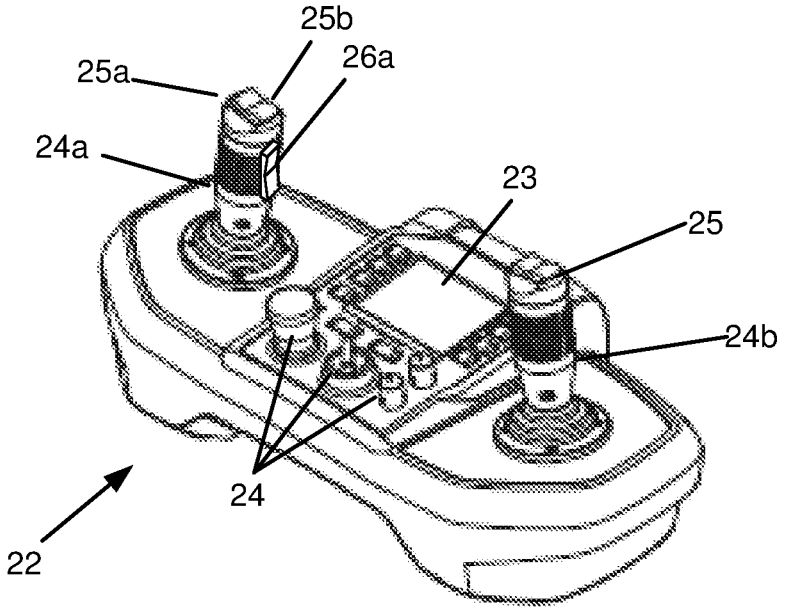
FIG. 2 shows a remote control 22 for a remote demolition robot according to an embodiment of the teachings herein.

FIG. 2 shows a remote control 22 for a remote demolition robot such as the robot 10 in FIG. 1. The remote control 22 has one or more displays 23 for providing information to an operator, and one or more controls 24 for receiving commands from the operator. The controls 24 include one or more joysticks, a left joystick 24*a* and a right joystick 24*b* for example as shown in FIG. 2, being examples of a first joystick 24*a* and a second joystick 24*b*. It should be noted that the labeling of a left and a right joystick is merely a labeling used to differentiate between the two joysticks 24*a*, 24*b*. A joystick 24*a*, 24*b* may further be arranged with a top control switch 25. The joysticks 24*a*, 24*b* and the top control switches 25 are used to provide maneuvering commands to the robot 10. The control switches 24 may be used to select one out of several operating modes, wherein an operating mode determines which control input corresponds to which action.

As touched upon in the above, the remote control 22 may be seen as a part of the robot 10 in that it may be the control panel of the robot 10.

The remote control 22 is thus configured to provide control information, such as commands, to the robot 10 which information is interpreted by the controller 17, causing the robot 10 to operate according to the actuations of the remote control 22.

Figure 3:
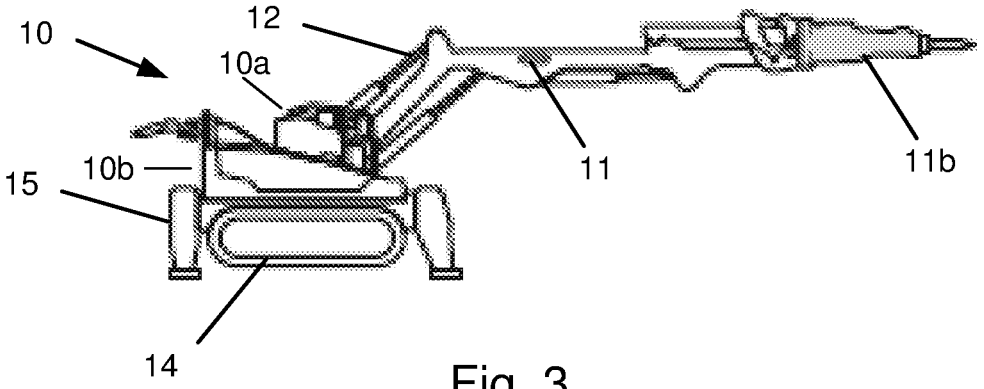
FIG. 3 shows a schematic view of a robot according to an embodiment of the teachings herein.

FIG. 3 shows a schematic view of a carrier, such as the robot 10 according to FIG. 1. In FIG. 3, the caterpillar tracks 14, the outriggers 15, the arms 11 and the hydraulic cylinders 12 are shown. An accessory 11*b*, in the form of a hammer 11*b*, is also shown (being shaded to indicate that it is optional).

As the controller 17 receives input relating for example to moving a robot member 11, the corresponding valve 13*a* is controlled to open or close depending on the movement or operation to be made.

Figure 4:
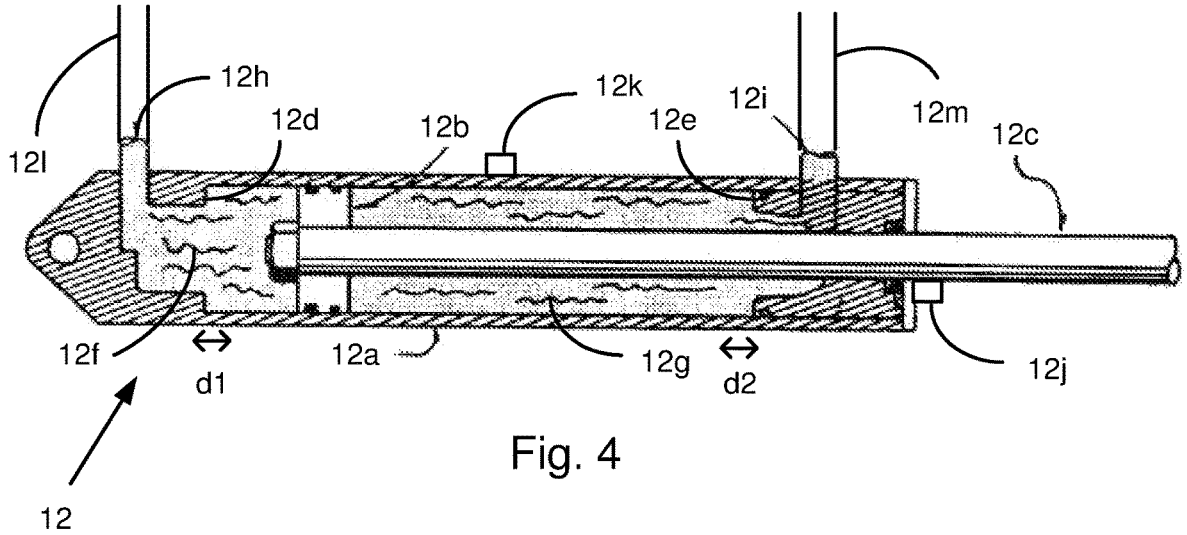
FIG. 4 shows a schematic view of a hydraulic cylinder according to an embodiment of the teachings herein.

FIG. 4 shows a schematic view of a hydraulic cylinder 12. The hydraulic cylinder 12 comprises a cylinder barrel 12*a*, in which a piston 12*b*, connected to a piston rod 12*c*, moves back and forth. The barrel 12*a* is closed on one end by the cylinder bottom (also called the cap) 12*d* and the other end by the cylinder head (also called the gland) 12*e* where the piston rod 12*c* comes out of the cylinder. Through the use of sliding rings and seals the piston 12*b* divides the inside of the cylinder 12*a* into two chambers, the bottom chamber (cap end) 12*f* and the piston rod side chamber (rod end/head end) 12*g*. The hydraulic cylinder 12 gets its power from a pressurized hydraulic fluid (shown as greyed out areas with wavy lines), which is typically oil, being pumped into either chamber 12*f*, 12*g* through respective oil ports 12*h*, 12*i* for moving the piston rod in either direction. The hydraulic fluid, being supplied through hydraulic fluid conduits 12*l*, 12*m*, is pumped into the bottom chamber 12*f* through the bottom oil port 12*h* to extend the piston rod and into the head end through the head oil port 12*i* to retract the piston rod 12*c*.

The hydraulic cylinder 12 is further arranged with a piston position sensor 12*j*. Many alternatives for a piston position sensor exist being of various magnetic, optical, and/or electrical designs. The piston position sensor 12*j* is configured to determine the position of the piston 12*b* in the barrel 12*a*, possibly by determining the position of the piston rod 12*c* relative the barrel 12*a*.

The piston position sensor 12*j* may be an integrated part of the cylinder 12, or it may be an add-on feature that is attached to or assembled on the cylinder 12. The piston position sensor 12*j* is communicatively connected to the controller 17 for transmitting piston position information received by the controller 17 which enables the controller 17 to determine the position of the piston 12*b* in the barrel 12*a*.

The piston position sensor 12*j* may also or alternatively be arranged as an angle detector between two arm members 11 that are controlled by the hydraulic cylinder 12. By knowing the angle between two arm members, the controller may determine the position of the piston as, for a fixed pivot point, the angle will be directly proportional to the piston position.

The inventor has realized that by knowing the position of the pistons 12*b*, it is possible to overcome the drawbacks of the prior art especially as regards the wear and tear of the cylinders. As has been discussed in the above, as a cylinder reaches an end position, the wall of that end will be subjected to a substantial force, both when the movement is stopped by the end, and also during operation of a tool, as all the tool's movements and/or vibrations as well as any shocks, that the tool is subjected to, will be translated into the wall.

The inventor therefore provides a manner of reducing the wear and tear of a cylinder, as well as the stability and smoothness of operation, by configuring the controller 17 to receive piston position information for the piston (directly or indirectly) from a piston position sensor 12*j* and based on the piston position information controlling the movement of the piston 12*b* so as to stop at a distance d1, d2 from an end wall 12*d*, 12*e* of the hydraulic cylinder 12. That is, at a distance d1, d2 from either or both of the bottom end wall 12*d* or the head end wall 12*e*. This provides for a buffer or cushion of hydraulic fluid between the piston 12*b* and an end wall 12*d*, 12*e* of the hydraulic cylinder 12. The distance d1, d2 is selected such that the buffer of hydraulic fluid can absorb any shocks subjected to the piston 12*b* or the respective cylinder end wall (bottom end wall 12*d* or head end wall 12*e*), thereby protecting and reducing the wear and tear of both the piston 12*b* and the respective end 12*d*, 12*e*. That is, the distance d1, d2 is selected such that the buffer of hydraulic fluid prevents the piston 12*b* from contacting an end wall 12*d*, 12*e* of the hydraulic cylinder 12. Contact between the piston and an end walls 12*d*, 12*e* is prevented both when a force acts on the piston 12 and when no force act on the piston. The force acting on the piston may for example impact or shocks from operation of a tool, such as a hammer, carried by the piston.

The bottom distance d1 may equal the head distance d2, or they may differ. Having different distances provides for a possibility to increase the range for the arm member or boom 11. For example, for a carrier equipped with a hammer it could be that the end opposite to the end on which the hammer is arranged is subjected to greater forces than the end on which the hammer is arranged. If the hammer is arranged on the piston rod 12*c* or on a member (not shown in FIG. 4) connected to the piston rod 12*c*, the head distance d2 could be made smaller, for example 5 mm, mostly protecting against movement shocks, and the bottom distance d1 could be made larger, for example 10 mm, also protecting against shocks to be absorbed from the operation of the hammer.

This allows for the reach of the arm or boom 11 to be increased or at least only marginally decreased while still allowing for a decrease in wear and tear, as well as increased smoothness of operation.

In one embodiment, one of the distances d1 or d2 may even be negligible and close to 0 mm. In such an embodiment, the carrier and the cylinder may rely on the skillfulness of the operator and/or soft stop functions.

The inventor has further realized that as different tools have different operating characteristics, the controller 17 may also be configured to determine one or both of the bottom distance d1 and head distance d2 according to the type of accessory being used.

If, for example a hammer is to be used—which is subject to forceful vibrations and shocks—a larger distance could be used, whereas if a digging bucket is to be used—which is not subjected to as forceful vibrations or shocks—a smaller distance could be used, thereby maintaining or at least only marginally decreasing the reach of the arm 11.

In such embodiments, the controller 17 is configured to receive an indication of the accessory type and set the distance(s) accordingly. The accessory type may be received through the wireless interface 18 that may be arranged to communicate with the accessory, for example through reading an RFID tag arranged on the accessory.

The accessory type may also or alternatively be received through the remote control 22 or the HMI interface by the operator inputting the accessory type, possibly through a selection from a list of available tools/accessories.

In one embodiment, the controller 17 is configured to set one or both of the bottom distance d1 and the head distance d2 according to the examples given below.

| Accessory | distance |
|---|---|
| Hammer | D1 |
| Drum Cutter | D2 |
| Steel Shearer | D3 |
| Cutter | D4 |
| Digging bucket | D5 |
| Payload | D6 |

Where D1≥D2≥D3≥D4≥D5≥D6, and where D1, D2, D3, D4, D5 and D6 is for example in the range 1-30 mm, in the range 1-25 mm in the range 1-20 mm, in the range 1-10 mm, in the range 1-5 mm, in the range 5-10 mm or any sub range therein. It should be noted that these ranges are example ranges, and other ranges, also outside the ranges given herein, may be used.

The bottom distance d1 and/or the head distance d2 may also be set differently depending on the hydraulic hoses being used. If rubber hoses are used, which rubber hoses are elastic and thus provide for some flexibility and thereby also some dampening, a smaller distance d1, d2 may be used, whereas if inflexible or more or less rigid hoses or conduits are used, a larger distance d1, d2 may be used.

The carrier is thus configured to adapt one of or both the stop distances d1, d2 depending on the conduits used in the hydraulic systems. This may be set by the designer of the carrier, inputted by the operator, or set by the controller 17 after having received an indication of what type of conduit is being used. The indication may be given when receiving the accessory type should one sort of accessory be known to have a specific type of conduits.

As there is a trade-off between the reach and the shock protection, the inventor has realized that the controller may be configured to dynamically set either or both of the stop distances d1, d2 based on the current operation. This is especially useful for a carrier having many arms or booms for which a combined movement may result in a same reach but through a different constellation, wherein one boom experiencing a lot of shocks may be given a larger stop distance, whereas another boom may be given a smaller stop distance thereby maintaining the same reach.

In one such embodiment, the controller is configured to receive vibration or shock indications from a vibration/shock sensor 12*k* arranged adjacent to, on or in the hydraulic cylinder 12, or even in indirect contact such as on the arm member 11 carrying the cylinder 12 or a connecting arm member 11 and based on the vibration or shock indications adapt one or both of the stop distances d1, d2 accordingly, where an increase in or a high level of (above a threshold) magnitude and/or frequency of vibrations and/or shocks results in an increase in a corresponding stop distance d1, d2.

In one such embodiment, the controller 17 is configured to determine that a piston is only rarely reaching a stop distance, such as the frequency of reaching a stop distance relative the number of moves being below a threshold value, for example 5% or less. If this is determined and the shock or vibrations is above a threshold value, the controller 17 is configured to increase the stop distance to provide for an increased dampening at the cost of a decreased reach, which should have little consequence as the full reach is not or only rarely utilized. Similarly, if the controller determines that the shocks or vibrations are below a threshold value and the stop distances d1, d2 are reached frequently, such as the frequency of reaching a stop distance relative the number of moves being above a threshold value, for example 30% or higher, the controller may decrease one or both of the stop distances d1, d2. In such embodiments, the threshold values may be based on the currently used accessory, the currently used stop distances d1, d2 and/or the current level of shocks or vibrations.

The shocks or vibrations detected and to be compared with the threshold values may be compared using absolute values or average values.

It should be noted that as so-called soft stop movement control only deal with the forces experienced when moving a tool or other accessory and is thus inferior to the solution proposed herein. Furthermore, different tools may require different cushions even when using soft stop due to different loads. In such a case, a carrier according to the teachings herein may set a stop distance according to the weight of the accessory so that heavy accessories that may be difficult or impossible to adequately stop using soft stop are stopped before they contact a wall end, even when using soft stop, whereas smaller loads may be operated or moved with a small or negligible stop distance.

Figure 5:
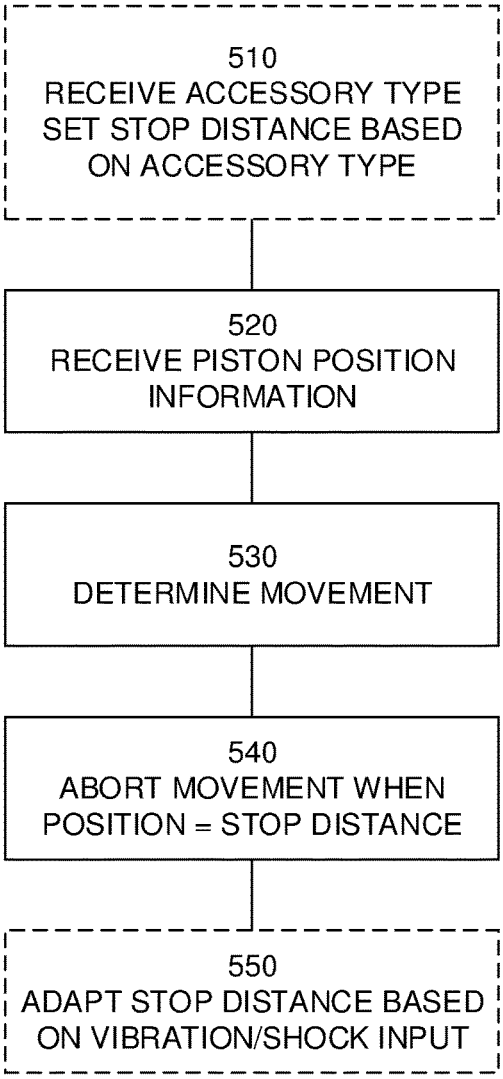
FIG. 5 shows a flowchart for a general method according to an embodiment of the teachings herein.

FIG. 5 shows a flowchart for a general method according to herein. The controller may optionally (as is indicated by the dashed lines) receive an indication of an accessory type 510. The controller then sets a stop distance based on the accessory type. Alternatively, the stop distance may be set to a default value. During operation of the carrier, the controller receives piston position information from at least one of the hydraulic cylinders through which the current position of the piston may be determined 520. The controller is further configured to determine that the piston is moved 530, that is that the hydraulic cylinder is activated, and in which direction the piston is moved and in response thereto determine if the piston is at a stop distance from one of the end walls of the cylinder (in the direction of the movement), and if so abort or stop the movement of the piston 540. The controller may be configured to preemptively abort the movement of the piston before the piston reaches the stop distance to make sure that the piston has time to stop before reaching the stop distance. Optionally the controller may also receive vibration or shock sensor input, and based on this dynamically adapt the stop distance 550.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A carrier comprising a hydraulic cylinder having a piston, a controller and a piston position sensor, wherein the carrier is arranged to carry an accessory through the use of the hydraulic cylinder and wherein the controller is configured to:

receive piston position information;

determine a direction of movement of the piston; and if the piston position equals a stop distance from an end wall of the hydraulic cylinder in the direction of movement, abort the movement;

wherein the controller is further configured to receive an indication of an accessory type and set the stop distance according to the accessory type.

2. The carrier according to claim 1, wherein the stop distance is a bottom stop distance associated with a bottom end of the hydraulic cylinder.

3. The carrier according to claim 2, wherein the stop distance is a head stop distance associated with a head end of the hydraulic cylinder.

4. The carrier according to claim 3, wherein the head stop distance is different from the end stop distance.

5. The carrier according to claim 3, wherein the head stop distance equals the end stop distance.

6. The carrier according to claim 1, further comprising a vibration or a shock sensor, wherein the controller is further configured to receive vibration or shock information and based on the vibration or shock information adapt the stop distance.

7. The carrier according to claim 6, wherein the controller is further configured to determine that the stop distance is to be adapted based on the vibration or shock information exceeding a threshold value, wherein the threshold value is based on the accessory type.

8. The carrier according to claim 1, wherein the stop distance is based on an elasticity of a hydraulic fluid conduit of the carrier.

9. The carrier according to claim 1, wherein the accessory is a hammer, a cutter, a drum cutter, a steel shearer, a saw, a digging bucket, or a payload.

10. The carrier according to claim 1, wherein the carrier is a remote demolition robot.

11. The carrier according to claim 1, wherein the carrier is an excavator, a backhoe loader, or a loader.

12. A method for use in a carrier comprising a hydraulic cylinder having a piston, a controller, and a piston position sensor, wherein the carrier is arranged to carry an accessory through the use of the hydraulic cylinder, wherein the method comprises:

receiving piston position information;

determining a direction of movement of the piston;

if the piston position equals a stop distance from an end wall of the hydraulic cylinder in the direction of movement, aborting the movement; and receiving an indication of an accessory type and setting the stop distance according to the accessory type.

13. A carrier comprising:

a hydraulic cylinder having a piston;

a controller; and a piston position sensor;

wherein the carrier is arranged to carry an accessory through the use of the hydraulic cylinder; and wherein the controller is configured to:

receive piston position information;

determine a direction of movement of the piston;

if the piston position equals a stop distance from an end wall of the hydraulic cylinder in the direction of movement, abort the movement; and increase or decrease the stop distance in response to determining that a frequency of reaching the stop distance relative a number of moves is below a first threshold value and shock or vibration information is above a second threshold value.

14. The carrier according to claim 13, wherein the controller is configured to increase the stop distance in response to determining that the frequency of reaching the stop distance relative the number of moves is below the first threshold value and shock or vibration information is above the second threshold value.

15. The carrier according to claim 13, wherein the controller is configured to decrease the stop distance in response to determining that the frequency of reaching the stop distance relative the number of moves is below the first threshold value and shock or vibration information is above the second threshold value.

* * * * *